United States Patent [19]

McClintock

[11] 4,091,974

[45] May 30, 1978

[54] MULTI-USE CAMERA HARNESS

[76] Inventor: Wayne E. McClintock, Box 848, El Paso, Tex. 79945

[21] Appl. No.: 733,518

[22] Filed: Oct. 18, 1976

[51] Int. Cl.[2] ..... A45F 5/00

[52] U.S. Cl. ..... 224/5 V; 224/5 P

[58] Field of Search ..... 224/5 R, 5 BC, 5 MC, 224/5 N, 5 P, 5 Q, 5 S, 5 V, 5 A, 5 B, 6, 25 R; 354/82, 293, 81; 2/2, 44, 45; 24/3 B; 352/243

[56] References Cited

U.S. PATENT DOCUMENTS

| | | | |
|---|---|---|---|
| 1,340,076 | 5/1920 | Orr | 224/5 P |
| 1,633,586 | 6/1923 | Hunter | 2/2 X |
| 2,487,423 | 11/1949 | Cast | 2/2 |
| 3,152,738 | 10/1964 | Worsfold | 224/5 V |
| 3,229,694 | 1/1966 | Koropp | 2/2 X |
| 3,363,814 | 1/1968 | Hall | 224/5 V |
| 3,602,409 | 8/1971 | Kerns | 224/5 V |
| 3,657,739 | 4/1972 | Holmes | 2/2 |
| 3,799,413 | 3/1974 | McBain | 224/5 P |

*Primary Examiner*—Trygve M. Blix
*Assistant Examiner*—Winston H. Douglas
*Attorney, Agent, or Firm*—Clarence A. O'Brien; Harvey B. Jacobson

[57] ABSTRACT

A multi-use camera harness having an elastic strap provided with a fastener for connecting together ends of the elastic strap. The elastic strap is disposed threaded through slots provided in a collar strap arrangeable around the back of the neck and over the shoulders of a wearer of the harness. The elastic strap passes under the armpits and fastens on the back of the wearer, while suitable attaching devices, such as D-rings, are mounted on the collar strap for supporting camera equipment from suitable support straps connected to the D-rings.

3 Claims, 5 Drawing Figures

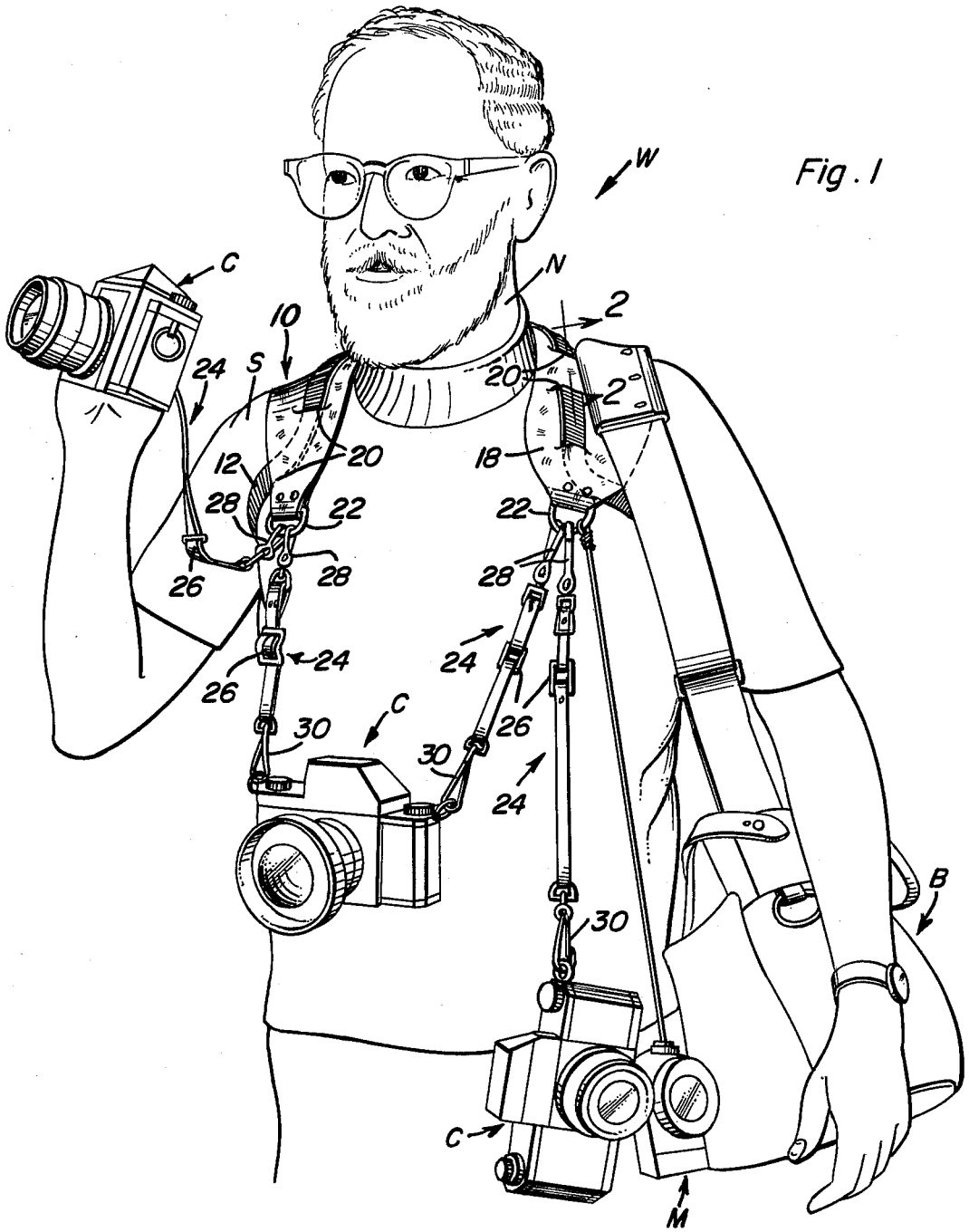
Fig. 1
Fig. 2
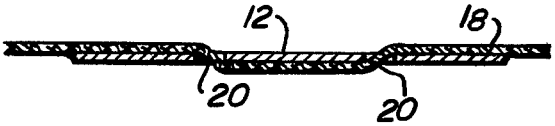

MULTI-USE CAMERA HARNESS

BACKGROUND OF THE INVENTION

1. Field of the Invention

This invention relates generally to article carrying harnesses, and particularly to a multi-use harness specifically intended for permitting a wearer to conveniently carry cameras and camera equipment.

2. Description of the Prior Art

It is generally known to provide a body harness for carrying a camera or cameras. One advantage of using such a harness is that a plurality of cameras, each with a different lens, can be simultaneously carried, possibly with other camera equipment such as light meters and even a camera bag, so as to be ready for use by the photographer. Examples of body harnesses particularly intended for carrying cameras can be found in prior U.S. Pat. Nos. 3,152,738, issued Oct, 13, 1964 to J. E. Worsfold, Jr.; 3,305,148, issued Feb. 21, 1967 to A. E. Zimmerman; 3,507,424, issued Apr. 21, 1970 to H. H. Burkins; and 3,602,409, issued Dec. 19, 1968 to R. L. Kerns.

SUMMARY OF THE INVENTION

It is an object of the present invention to provide a body harness which spreads the weight of articles supported by the harness across the top of the shoulders of the wearer, and accordingly takes weight off of the back of the neck of the wearer and eliminates fatigue resulting from weight on the neck.

It is another object of the present invention to provide a body harness providing support for a large number of cameras, camera accessories, and other articles while allowing for full movement of a camera or cameras being supported so as to permit any of the cameras to be positioned as desired, even for the taking of vertically-framed pictures.

It is yet another object of the present invention to provide a body harness specifically suited for supporting a camera or cameras wherein a quick release of the camera or cameras is available.

It is a still further object of the present invention to provide a body harness which can be worn over or under foul weather clothing, and the like, so as to permit a wearer to use the harness outdoors during cold weather, and the like.

It is still another object of the present invention to provide a body harness, which can be hidden under a coat or jacket, and can specifically carry a camera or cameras that will hang out of sight under the coat sides, with the candid photographer slipping the camera from its hiding place to take a quick picture, and returning it to its covered place.

It is still another object of the present invention to provide a body harness specifically for carrying camera equipment wherein the equipment can be spaced about the body of the wearer in order to prevent the cameras, and the like, from getting in the way of one another.

These and other objects are achieved according to the present invention by providing a harness having: an elastic strap or band provided with a pair of ends and with a fastener disposed for connecting together the ends of the band; a collar strap provided with an arrangement for retainingly engaging the elastic band, the latter being arrangeable under the armpits and passing behind the back of a wearer in order to permit the fastener to secure the band behind the back of the wearer; and an attachment arrangement provided on the collar strap for permitting fastening of articles to the collar strap.

The collar strap advantageously is provided with a plurality of slots forming the arrangement engaging the elastic band, with the elastic band being threaded through the slots. The collar strap is arrangeable around the back of the neck and over the shoulders of a wearer, with the elastic band being similarly disposed together with the collar strap so as to pass under the armpits of the wearer from the wearer's front.

The attachment arrangement can include at least one and preferably a plurality of D-rings mounted at spaced points on the collar strap. In one preferred embodiment of the invention, the collar strap is a longitudinally extending element having a pair of longitudinally spaced ends, with each of the ends being provided with a D-ring. In another preferred embodiment of the invention, the collar strap is a longitudinally extending element having two longitudinally spaced bifurcated ends. Each of these bifurcated ends is provided with a pair of portions diverging from one another so as to extend from opposite front or back sides and associated shoulder of a wearer of the harness, with each of the portions of a bifurcated end of the collar strap being provided with a D-ring.

The attachment arrangement advantageously further includes an adjustable strap provided with a snap hook, and the like, connected to the D-ring, and with a suitable securing device, such as another snap hook, provided on a portion of the strap adjustably spaced from the D-ring for attachment to camera equipment.

These together with other objects and advantages which will become subsequently apparent rise in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a fragmentary, perspective view showing a multi-use camera harness according to the present invention supporting various camera equipment from the body of a photographer.

FIG. 2 is an enlarged, fragmentary, sectional view taken generally along the line 2—2 of FIG. 1.

DESCRIPTION OF THE PREFERRED EMBODIMENTS

Figure 3:
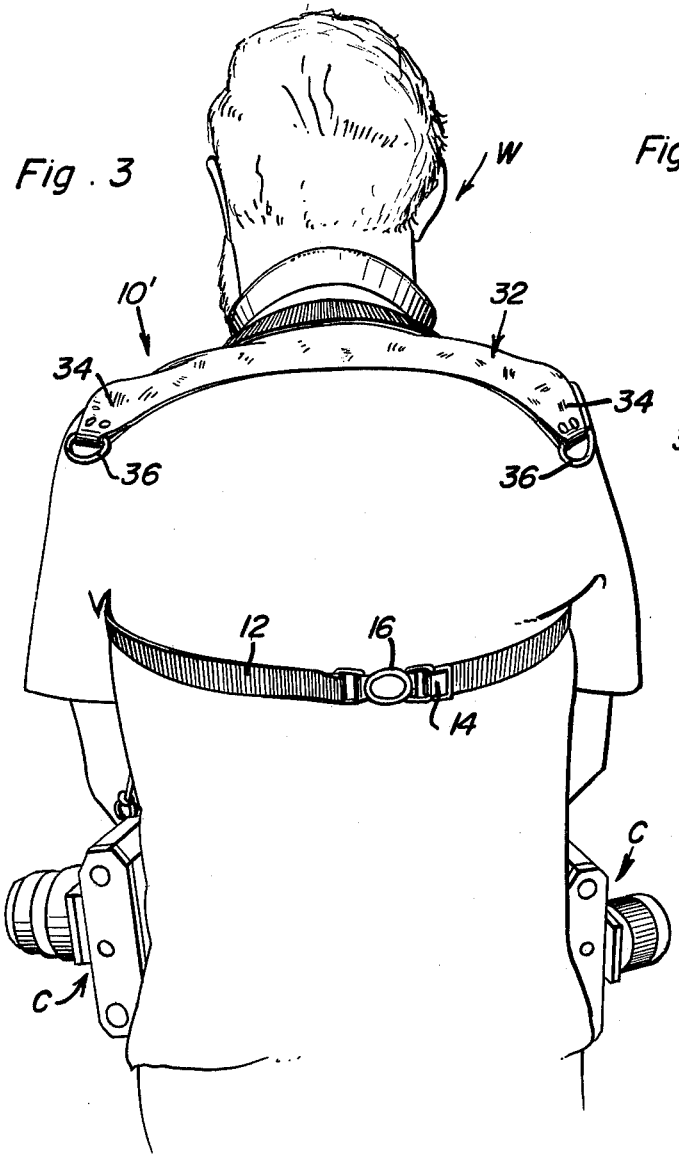
FIG. 3 is a fragmentary, prespective view looking from the rear of a photographer and showing a second embodiment of a harness according to the present invention.

Referring now more particularly to FIGS. 1 and 2 of the drawing, a multi-use camera harness 10 according to the invention includes an elastic band 12 provided with a pair of ends and with a fastener including a buckle 14 (FIG. 3) and a catch 16 for connecting together the ends behind the back of the wearer W of harness 10 in the manner shown in FIG. 3. Harness 10 also includes a collar strap 18 provided with a plurality of slots 20 disposed for retainingly engaging with the band 12. More specifically, the band 12 is threaded through the slots 20 so as to be arrangeable under the armpits of wearer W and permit the ends of band 12 to pass behind the back of wearer W. Collar strap 18 is arrangeable around the back of neck N and over the shoulders S of wearer W so as to permit the band 12 to pass under the armpits of wearer W from the front to the back.

D-rings 22 are provided on collar strap 18 for permitting fastening to strap 18 of articles such as the illustrated cameras C and light meter M, and other camera accessories, and the like, not illustrated.

As can be seen from FIG. 1, collar strap 18 of harness 10 is a longitudinally extending element having a pair of longitudinally spaced ends, with each of the ends being provided with a respective D-ring 22 attached to strap 18 as by a pair of rivets.

The attachment arrangement advantageously further includes a supporting strap 24 adjustable in a conventional manner as by means of a buckle 26 and provided with a snap hook 28 removably connected to a D-ring 22. The end of strap 24 spaced from snap hook 28 is provided with a suitable device for securing strap 24 to an article of camera equipment such as camera C. This securing device can also be a snap hook such as that designated 30. Each of the snap hooks 28 and 30 is swivel mounted for permitting full orientation of the camera equipment.

Figure 4:
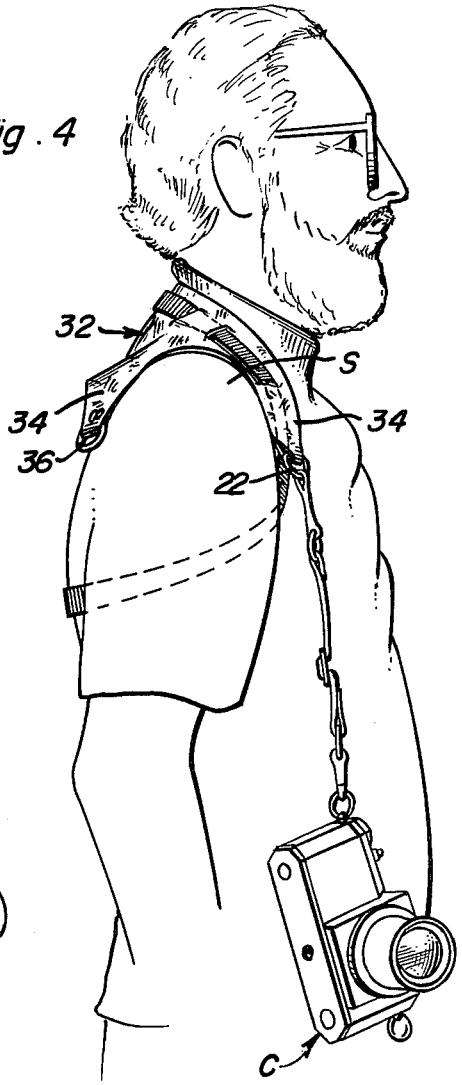
FIG. 4 is a fragmentary, perspective view looking from the right in FIG. 3.
Figure 5:
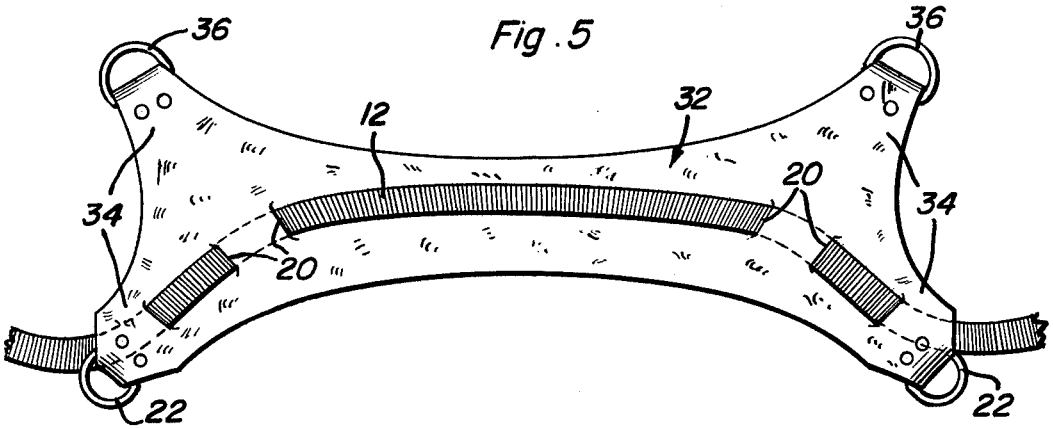
FIG. 5 is a fragmentary, plan view showing the harness of FIGS. 3 and 4.

Referring now more particularly to FIGS. 3 through 5 of the drawings, a harness 10' according to the invention is similar to harness 10, except that collar strap 32 is a longitudinally extending element having two longitudinally spaced bifurcated ends, with each of the ends including a pair of portions 34 diverging from one another and each provided with a D-ring 22, 36. The divergence of the portions 34 permits the bifurcated ends of strap 32 to straddle a shoulder S of a wearer W of the harness 10' such that the portions 34 of each of the bifurcated ends lie on opposite sides of an associated shoulder of the wearer.

A particular advantage of the addition of the D-rings 36 at the back of wearer W is that harness 10' can be used to hang a flash unit battery section (not shown) or a camera bag (not shown) through the use of at least one of the two D-rings 36.

As can be appreciated from the above description and from the drawings, a multi-use camera harness according to the invention spreads the weight of cameras and other equipment across the top of the shoulders of the wearer, taking such weight off of the back of the neck and eliminating the resulting fatigue. Further, the design of the collar strap also puts the hanging point of the D-rings holding the camera and other equipment over the armpits of the wearer and makes them easily available for use. In the embodiment shown in FIGS. 3 through 5 of the drawings, the two extra D-rings 36 fall over the shoulders to the back of the wearer at the exact point needed to allow two cameras to be readily available at the same time the two front cameras are in a ready position on the front D-rings 22. The elastic band running through both embodiments of the harness provides a unique way of securing the collar strap's position on the shoulders of the wearer by looping forwards over the shoulders at the armpits, going under the armpits, and around behind the back to a point where a suitable coupling allows for easy fastening.

The security of the collar strap on top of the shoulders eliminates a common problem of photographers of carrying cameras that normally slide off the right or left shoulders. In addition, the adjustable strap 24 attaching the cameras to the collar strap allows free and easy use of the cameras. The embodiment of the invention shown in FIGS. 1 and 2 of the drawings allows a camera to hang from either the right or left ring, or both, and a third camera from both rings, across the chest, almost in the normal fashion. Thus, this arrangement allows the use of three cameras. In the four-ring version shown in FIGS. 3 through 5, up to five cameras can be at the immediate disposal of the photographer.

The multi-use camera harness according to the invention thus allows a cameraman to have at the ready, and secure, cameras with, for example, normal, wide-angled, and telephotolenses, and also a combination of cameras with the different lenses and different types of films, both black and white and color.

For example, the two-ring embodiment of FIGS. 1 and 2 could allow a normal lens on one camera and a wide-angled lens on the other. A telephoto could replace either for another combination. Or, both cameras could have the same or different lenses, and one could have black and white film and the other color film. The four-ring version shown in FIGS. 3 through 5 can allow a photographer to carry five different cameras with different combinations of lenses and films.

Or, the four-ring version of FIGS. 3 through 5 could hang other equipment on the back D-rings 36, even a sort of ski "fanny" pack as a camera and camera accessory bag.

Another advantage of the multi-use camera harness according to the invention is that it can go over foul weather or winter coats, and makes it especially advantageous for use when covering football games in cold weather, and the like, or it can go under such coats allowing an extra advantage of hiding the cameras especially when using small, thin, wide-angled cameras on occasions when a photographer wants to hide the fact that he is taking photographs.

In summary, therefore, the multi-use camera harness according to the invention eliminates the jumbled mess of professional camermen having to sling five cameras and five different normal camera straps over both shoulders, with the result that the cameraman has difficulty in getting a camera to the eye to take a picture.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A multi-use camera harness adapted for being arrangeable around the neck and the shoulders of a wearer of the harness comprising, in combination:

(a) an elastic band provided with a pair of ends and with fastener means for connecting together the ends of the band;

(b) a collar strap provided with a plurality of slots forming means for retainingly engaging the elastic band, the latter being threaded through the slots and being arrangeable for passing behind the back of a wearer of the harness for retaining the collar strap on the wearer, the collar strap being arrangeable around the back of the neck and over the shoulders of a wearer of the harness, with the elastic band passing from the front under the armpits and behind the back of the wearer of the harness; and (c) attachment means arranged over the armpits of the wearer and provided on the collar strap for permitting fastening of articles to the collar strap, the elastic band assuring security of the position of the collar strap and attachment means on the wearer, the attachment means including a plurality of D-rings mounted at separate points on the collar strap, the collar strap being a longitudinally extending element having two longitudinally spaced bifurcated ends, with each of the ends provided with a pair of D-rings, the bifurcated ends each including a pair of portions diverging from one another for laying on opposite front and back sides of an associated shoulder of a wearer and each being provided with a respective D-ring, with the elastic band following along the front portion of each of the bifurcated portions.

2. A structure as defined in claim 1, wherein the attachment means further includes an adjustable strap provided with a snap hook connected to the D-ring, and with securing means for attaching the adjustable strap to camera equipment.

3. A structure as defined in claim 2, wherein the fastener means includes a buckle mounted on one of the ends of the elastic band and a catch mounted on the other of the ends of the elastic band, the buckle and catch being engageable for retaining the collar strap on the shoulders of the wearer of the harness.

* * * * *